US008276622B2

(12) United States Patent
Pedersen et al.

(10) Patent No.: US 8,276,622 B2
(45) Date of Patent: Oct. 2, 2012

(54) METAL SHEET VENTILATION/SMOKE DUCT SECTION AND MANUFACTURING METHOD THEREOF

(75) Inventors: Kurt Munk Pedersen, Borup (DK); Kenn Christensen, Havdrup (DK); Lars Elmekilde Hansen, Roskilde (DK)

(73) Assignee: Rockwool International A/S, Hedehusene (DK)

( * ) Notice: Subject to any disclaimer, the term of this patent is extended or adjusted under 35 U.S.C. 154(b) by 860 days.

(21) Appl. No.: 12/227,939

(22) PCT Filed: Jun. 6, 2007

(86) PCT No.: PCT/DK2007/000269

§ 371 (c)(1),
(2), (4) Date: Feb. 27, 2009

(87) PCT Pub. No.: WO2007/140780

PCT Pub. Date: Dec. 13, 2007

(65) Prior Publication Data

US 2009/0165776 A1 Jul. 2, 2009

(30) Foreign Application Priority Data

Jun. 8, 2006 (EP) ..... 06388042

(51) Int. Cl.
*F16L 9/14* (2006.01)

(52) U.S. Cl. ..... 138/149; 138/172; 285/424

(58) Field of Classification Search ..... 138/149, 138/172; 285/424
See application file for complete search history.

(56) References Cited

U.S. PATENT DOCUMENTS

| | | | | |
|---|---|---|---|---|
| 3,559,660 | A * | 2/1971 | Rollins | 138/149 |
| 4,061,162 | A * | 12/1977 | Jones et al. | 138/147 |
| 7,798,533 | B2 * | 9/2010 | Waldner | 285/123.16 |
| 2010/0212807 | A1 * | 8/2010 | Princell et al. | 156/92 |

FOREIGN PATENT DOCUMENTS

| | | | |
|---|---|---|---|
| DE | 32 27 500 | A1 | 1/1984 |
| DE | 20 2005 003 370 | U1 | 5/2005 |
| EP | 0 516 945 | A2 | 12/1992 |
| GB | 2 394 541 | A | 4/2004 |
| WO | WO-02/070962 | A1 | 9/2002 |

* cited by examiner

*Primary Examiner* — Patrick F Brinson
(74) *Attorney, Agent, or Firm* — Finnegan Henderson Farabow Garrett & Dunner LLP

(57) ABSTRACT

The invention relates to a metal sheet (15) ventilation/smoke exhaust duct section (10) for incorporation into a metal sheet ventilation/smoke exhaust duct, said metal sheets (15) being covered on the outside by a heat insulating material (20) and said duct section (10) including elongated stiffening bar members (30) located on the outside of the duct and attached to said metal sheets (15), the invention being characterized in said bar members (30) being located at a distance from said metal sheets (15), said bar members (30) being attached to said metal sheets (15) at discrete locations along the length of the bar members (30).

22 Claims, 3 Drawing Sheets

METAL SHEET VENTILATION/SMOKE DUCT SECTION AND MANUFACTURING METHOD THEREOF

BACKGROUND OF THE INVENTION

The present invention relates to a metal sheet ventilation/smoke exhaust duct section being a part of a metal sheet ventilation/smoke exhaust duct, where the metal sheets are covered on the outside by a heat insulating material and where the duct section includes elongated stiffening bar members located on the outside of the duct, attached to the metal sheets.

Fire regulations require that a tight seal be established in the area where the section of the ventilation/smoke exhaust duct passes through a fire rated wall such that flames and/or toxic gases largely will not pass from one building area to the adjoining building area in case of fire in one of the areas. DIN 4102 Part 4 requires the provision of vertical internal stiffening pipes and, as the case may be, a round-going stiffening frame made up from an L-shaped profile with one leg lying flatly against the metal sheet outer surface. The mounting of the aforementioned vertical pipes inside the duct is time-consuming and also restricts the free flow of air through the ventilation/smoke exhaust duct in normal operation. Moreover, it has been found that the aforementioned stiffening L-shaped frame often applied may in fact in certain cases bring about a further loss of seal between the duct section and the wall.

SUMMARY OF THE INVENTION

By the invention it has become possible to avoid the use of any of the aforementioned vertical pipes, or alternatively to reduce the number of any pipes applied or the dimensions of any pipes applied, without compromising the fire requirements. In relation to ventilation ducts the invention may, by way of example, find particular use in connection with fire rated walls to maintain the structural stability of the duct where the duct penetrates the fire rated wall; in smoke exhaust ducts the invention may find general use for keeping the structural stability along the length of the duct.

According to a preferred embodiment of the invention, the bar members are connected to form a frame extending around the ventilation/smoke exhaust duct metal sheets, and the heat insulating material is arranged between the frame and the ventilation/smoke exhaust duct metal sheets, preferably to act as a spacer ensuring the proper spacing between the frame and the metal sheets such that heat transfer between the bar members and the duct is restricted and such that temperature-induced deformations of the bar members are limited, whereby deformations of the metal sheets can be restricted or limited. Preferably U-shaped or T-shaped bars are used.

For attaching the bars to the ventilation/smoke exhaust duct section screws are preferably used, the screws being arranged with a mutual spacing along the length of the bar members of preferably between 200 mm and 700 mm. Hence, for each meter length of the bar members as few as 2-4 screws may be used.

BRIEF DESCRIPTION OF THE DRAWINGS

Various embodiments of the invention will now be described in details by reference to the drawings.

DETAILED DESCRIPTION OF THE INVENTION

Figure 1:
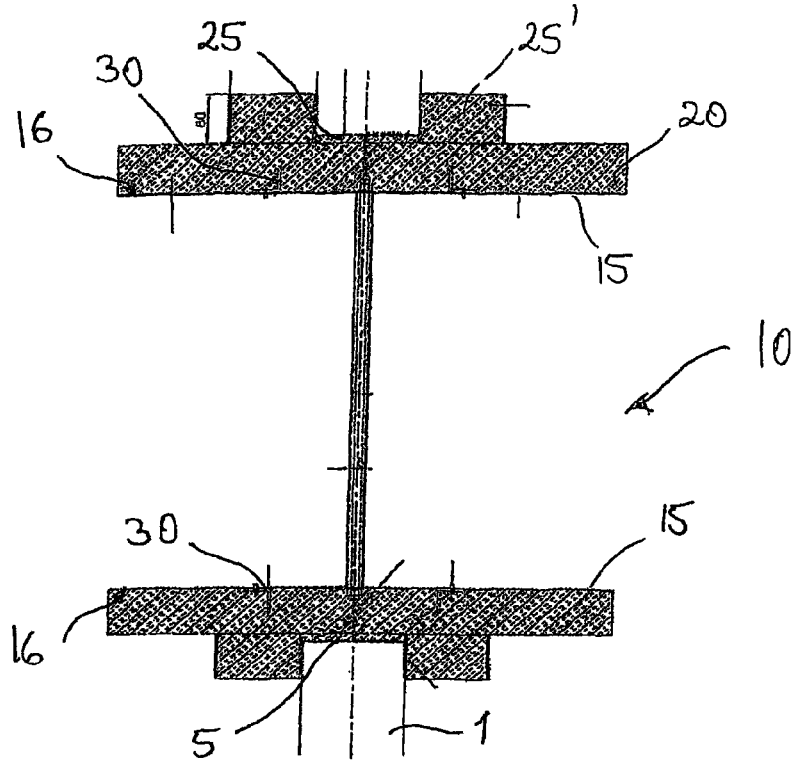
Fig. 1 PRIOR ART
FIG. 1 shows a vertical cross-sectional view through a wall with a through-going ventilation/smoke exhaust duct section, formed in accordance with DIN 4102 Part 4.

FIG. 1 shows a vertical cross-sectional view through a wall 1 separating two areas of a building and having a through-going opening 5 for a heat-insulated metal ventilation duct section 10 which is part of a building ventilation duct. By way of example only, the area to the left of the wall may contain the production facilities of a factory while the area to the right may be for the administrative facilities of the factory.

The metal ventilation duct section 10 has a square or rectangular cross-section and is formed from thin metal sheets 15 that delimit the duct proper, defining the vertical and horizontal sides of the duct. The two horizontal sides 16 of the duct section 10 are shown in FIG. 1. Heat insulating elements 20, such as mineral fiber slabs or plates, are mounted around the ventilation duct as is conventional. The ventilation duct is typically suspended by hangers (not shown) connected to the building ceiling, and is also supported by the wall 1 at the through-going opening 5.

Fire regulations require that a tight seal be established in the area 5 where the duct section 10 passes through the wall 1 such that flames and/or toxic gases largely will not pass from one area to the adjoining area in case of fire in one of the areas. Often this seal is established by arranging mineral wool heat insulating packers 25, 25' around the duct section 10 on both sides of the wall 1 and around the duct section 10 in the opening 5 proper.

In the case of fire, hot gases could flow inside the ventilation duct, and the duct metal sheets 15 after some time assume temperatures that give rise to metal sheet 15 deformations whereby the seal between the duct section 10 and the wall 1 becomes ineffective. The deformations typically show themselves in that the upper and lower horizontal sheets 15 flex inwardly, or sag, such that the inside vertical clearance of the duct section 10 is reduced along the centreline of the duct section 10. Hence, the aforementioned packers 25, 25' may be rendered ineffective along the horizontal edges of the through-going opening 5 of the wall 1.

To safeguard the seal it has been proposed to arrange within the duct section 10 vertical support pipes that effectively reduce the deformations of the duct section in the area of the seal by spanning the upper and lower horizontal metal sheets 15, the pipes being subjected to deformation generated axial loads in the event of fire. The provision of such vertical pipes and, as the case may be, a round-going stiffening frame made up from bars having an L-shaped profile 30 with one leg lying flatly against the outer surface of the duct section, is required by DIN 4102 Part 4/FIG. 84. A duct installation formed in accordance with DIN 4102 Part 4/FIG. 84 is shown in FIG. 1.

The mounting of the aforementioned vertical pipes inside the duct is time-consuming and also restricts the free flow of air through the ventilation duct in normal operation. Moreover, the applicant has found that the aforementioned stiffening L-shaped frame often applied may in fact in certain cases bring about a further loss of seal between the duct section 10 and the wall 1.

By the invention, to be discussed further below, it has become possible to avoid the use of any of the aforementioned vertical pipes, or alternatively to reduce the number of any pipes applied or the dimensions of any pipes applied.

Figure 2:
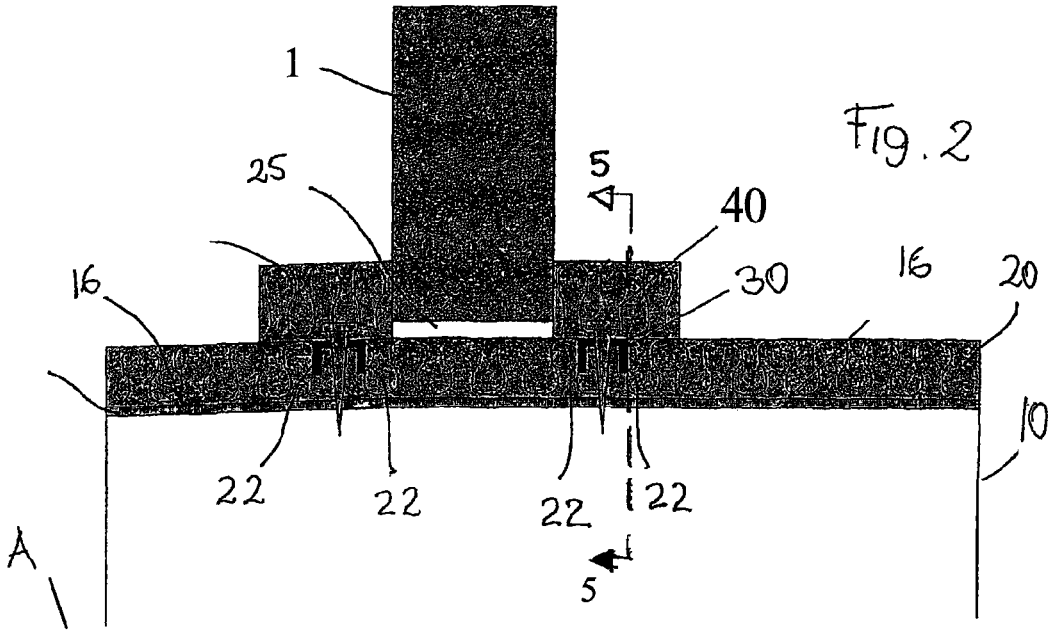
FIGS. 2-4 represent partial cross-sectional views similar to that of FIG. 1, and showing various embodiments of the invention.

One embodiment of the invention is shown in FIG. 2 which represents a partial vertical cross-sectional view similar to FIG. 1. In FIG. 2, a round-going rigid metal frame is positioned around the perimeter of a square duct section 10, on a respective side of the wall 1. The frame is formed from vertical and horizontal straight metal bars 30 having a U-section with the bottom of the U being located farthest from the metal sheets 15, although a T-section or an L-section, with the larger area part, such as the top of the T being located farthest from the metal sheets 15, could also be used. The bars 30 are connected at the ends (not shown), thus forming at the joints the corners of the round-going rigid frame. Alternatively, when the duct section 10 has a circular or similarly shaped cross-section the round-going frame may be formed from a straight band of similar cross-section and with the two ends thereof being joined. It is noted that only a single frame may be used. In smoke exhaust ducts the bars 30 may be arranged with a mutual spacing along the length of the duct of e.g. 300-600 mm.

The round-going frame shown in FIG. 2 has the bars 30 positioned at a distance from the outer surface of the duct section 10 metal sheet 15 such that any direct heat transmission between the bars and the metal sheets 15 of the duct section 10 is largely prevented. Preferably, on mounting the frame the worker makes sure that after proper installation there is no contact between the bars 30 and the duct section 10 metal sheets 15 at any point around the perimeter of the duct section 10. Normally this will follow readily from the fact that an insulating layer 20 of a given thickness covers the duct section 10 on the outside, the frame being mounted on the outer surface of the insulating layer 20. On mounting bars 30 having a U-formed cross-section, as shown in FIG. 2, the worker would preferably cut two parallel round-going grooves 22 into the insulating layer 20, the grooves 22 having a depth corresponding to ego half the thickness of the insulating layer 20 or to the height of the profile flanges, such that the profile 30 bottom bears against the outer surface of the insulating layer 20. The worker then inserts the bars 30 into the grooves 22, and connects the bars 30 at the ends, thus forming a rigid frame. After attaching the bars 30 to the duct section 10 as explained below he then applies any sealing packers 25, 25' as required.

Figure 3:
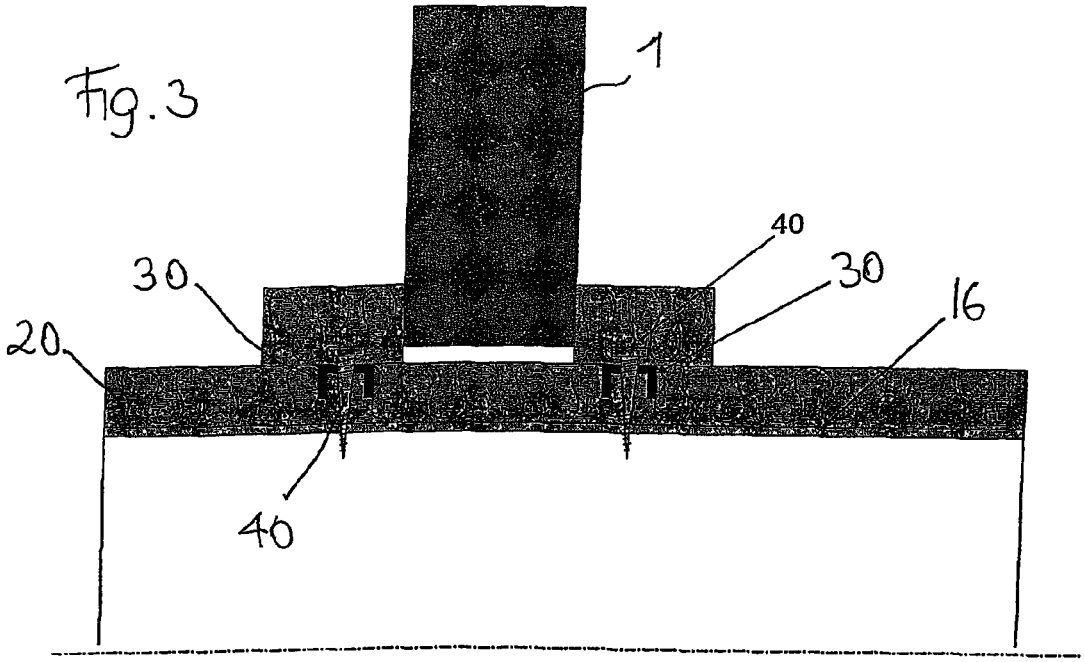
Figure 4:
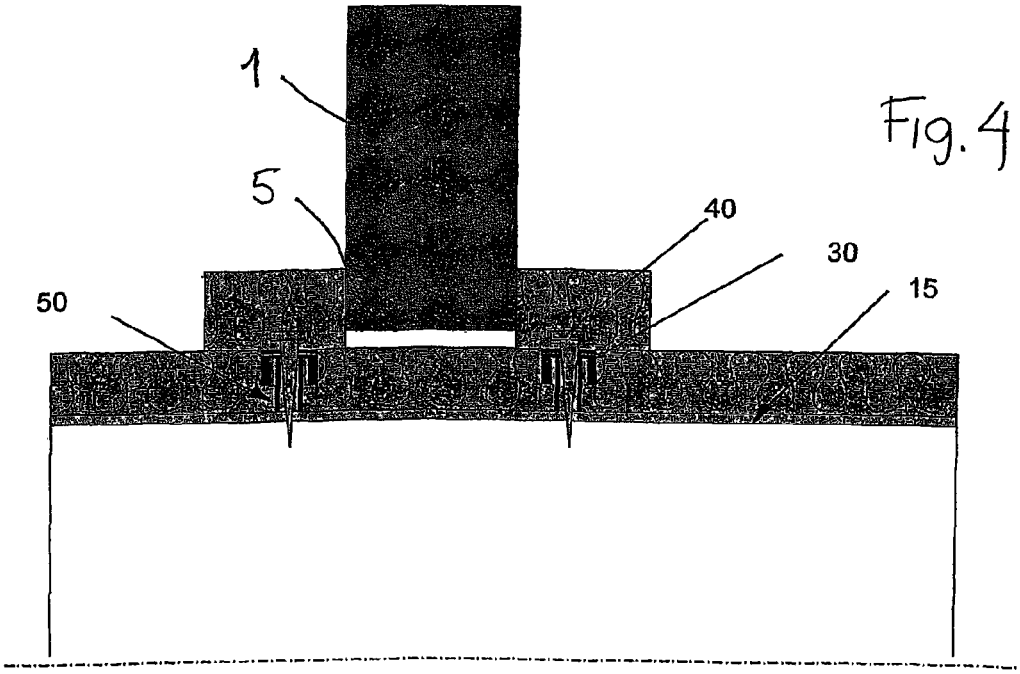

FIGS. 3 and 4 show partial cross-sectional views similar to FIG. 2, two alternative, preferred ways of attaching the frame to the duct section 10 thus being shown by way of example. The embodiments of FIGS. 2-4 involve the use of connecting screws 40 for providing the attachment.

As mentioned above, any direct heat transmission between the metal sheets 15 of the duct section 10 and the frame bars 30 should be avoided, or at least be reduced to a great extend. In this manner, temperature induced deformations of the bars 30 are reduced or delayed. Hence, generally the bars 30 forming the frame will be located at a distance from the metal sheets 15 forming the duct section 10 sides 16, the connection between the frame bars 30 and the duct section 10 preferably being provided in discrete areas or points by separate connecting means 40, such as screws, preferably self-cutting screws that preferably may be applied by the worker after the duct section 10 has been arranged in its final position extending through the wall 1, before or after the duct section 10 has been connected to the rest of the ventilation duct. The metal bars 30 may be provided with pre-drilled holes receiving the screws 40, the distance between the pre-drilled holes corresponding to the required number of screws per unit length of the bars 30, such that the worker does not apply an excessive number of screws 40. On applying the screws 40 the worker may take advantage of pre-drilled holes in the insulating material 20. However, in a preferred embodiment of the invention the worker would simply screw the screws 40 through the insulating material 20 and into the metal sheet 15 until the screw head engages the bar 30, to establish a reliable connection while at the same time maintaining the required spacing between the metal bars 30 and the metal sheets 15 of the ventilation duct section 10.

Alternatively, bolts pre-mounted to the duct section 10 metal sheets 15 and arranged to extend through holes in the bars 30 and secured to the bars 30 by nuts may be used. The screws or bolts 40 may be made from a material having smaller heat conductivity, compared to that of the bars 30.

Tests have shown that using ordinary 4-5 mm steel screws 40 applied at a number of two equidistant screws 40 per meter length of the bars in the case of 1000 mm by 250 mm or 1000 mm by 500 mm ducts will suffice to reliably connect the bars 30 to the duct section 10 while at the same time forming a structural reinforcement or stiffening of the duct section 10. The steel screws 40, i.e. the connecting means, transfer forces between the metal sheets 15 and the metal bars 30, reducing the aforementioned sagging of the metal sheets 15 in case of fire. The limiting of the heat transfer between the duct section 10 metal sheets 15 and the bars 30 of the frame and, hence, the temperature increase of the bars 30 that would otherwise result from the high temperature gases flowing within the ventilation duct reduces temperature induced deformations of the bars 30 proper such that the reinforcement or stiffening provided by the bar 30 frame remains effective for a prolonged period of time, effectively obviating any of the cumbersome pipes required by DIN 4102 Part 4.

To maintain the desired spacing between the frame bars 30 and the duct section 10 metal sheets 15 during use and in case of fire, double threaded screws 40 of the type shown in FIG. 3 may be used, or tubular spacers 50 resting on the duct section 10 metal sheets 15 and being of any desired material may be located in the area of screws 40 of conventional type, as shown in FIG. 4. Alternatively, a mineral wool material of a certain minimum density, such as about 150 kg/m$^3$, may be selected for the insulation layer 20. By selecting the density in accordance with the torque to be applied by the worker when inserting screws 40 into the duct section 10 metal sheets 15 the spacing between the frame bars 30 and the duct section 10 metal sheets 15 is determined i.a. by the insulating material 20 since the compression of the mineral fiber insulating layer 20 beneath the bars 30 arising from the tightening of the screws 40 is generally reduced with increasing density.

The frame bars 30 may alternatively be connected to the duct section 10 by small size legs (not shown) that are integral with the bars 30 and that extend out from the bars, resting on the duct section 10 metal sheets 15 like the tubular spacers 50 of FIG. 4 and being connected to the duct section 10 metal sheets 15, such as by soldering or welding obviating the use of screws 40, the attachment being such that axial forces, normally tensile forces in case of the attachments at the upper horizontal side 16 metal sheet 15, can be transferred from the duct section 10 to the bars 30. Direct heat transfer through the legs between the frame bars 30 and the duct section metal sheets 15 should be kept at a minimum.

In an alternative embodiment metal bars 30 as shown and explained herein may be located on the top and bottom side 16 metal sheets 15 of the ventilation duct section 10 only, i.e. dispensing from the use of a metal bar frame. In case of a square or rectangular cross-section ventilation duct section 10 the elongated metal bars 30 would then preferably extend across at least 90% of the horizontal width of the ventilation duct section 10.

Figure 5:
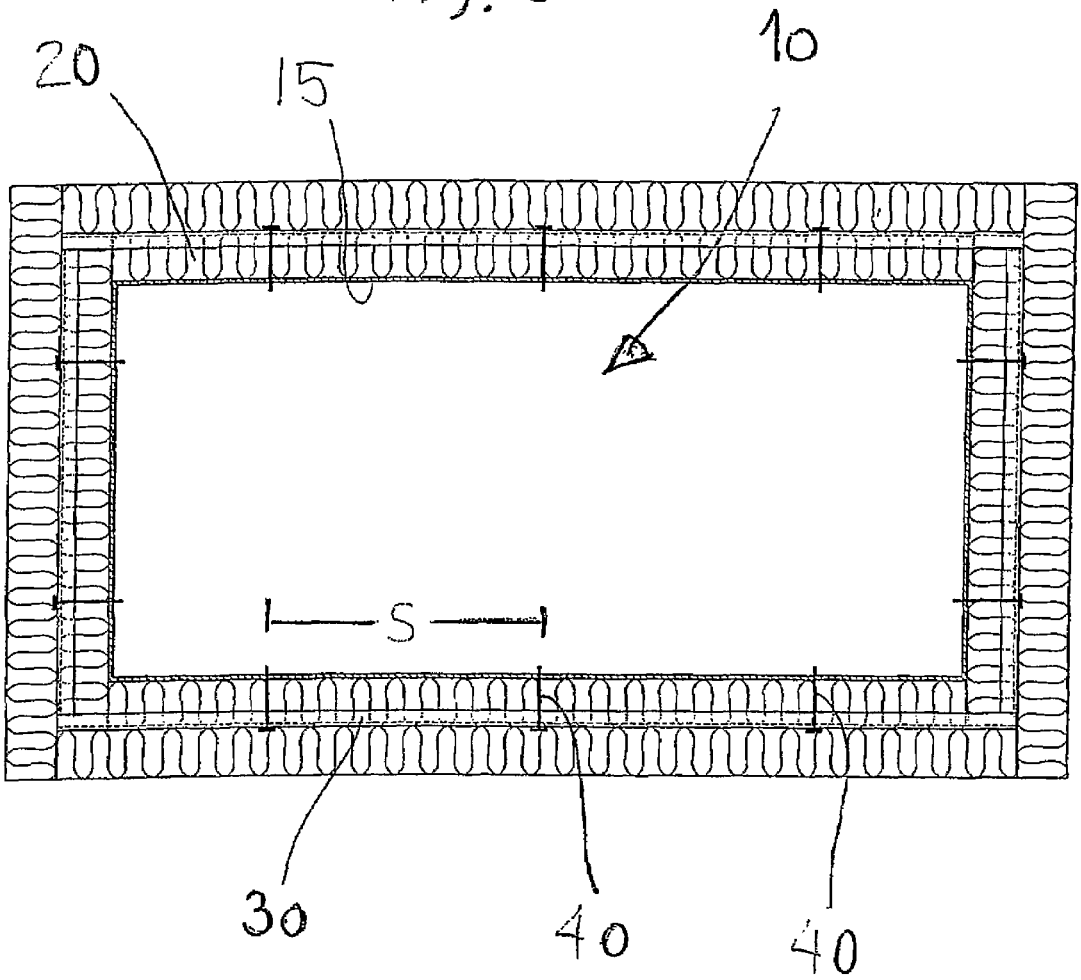
FIG. 5 is a cross-sectional view, taken as shown in FIG. 2.

FIG. 5 is a view taken as shown in FIG. 2 and illustrating the duct 10 with metal screws 40 arranged such that the metal bars 30 are attached to the metal sheets 15 at discrete locations spaced apart by distance S.

EXAMPLE

A rectangular ventilation duct section 10 as shown in FIG. 2 was made using 0.7 mm galvanized steel sheets 15, the duct section 10 having dimensions of 1000 mm by 250 mm and the U-shaped metal bars 30 forming the peripheral frame arranged perpendicularly to the axial extension A of the duct section 10 having a flange height of 25 mm and a moment of inertia of 1.22 $cm^4$. A mineral wool fire insulation plate 20 having a thickness of 60 mm was mounted around the duct section 10 against the metal sheets 15, and metal screws 40 arranged with a spacing of 33 cm were used to attach the metal bar 30 frame to the ventilation duct section 10. Parallel peripheral grooves 22 of a depth of about 25 mm were cut into the insulation plate 20 such that the innermost part of the metal bars 30 were kept at a spacing of 35 mm from the outer surface of the metal sheets 15. In fire tests the duct section 10 proved efficient in maintaining for a period of 120 minutes a seal as mentioned above in the area of the wall 1 opening 5, by the metal bars 30 resisting sagging of the metal sheets 15 through the connecting means 40, i.e. the screws, transferring forces between the metal bars 30 and the metal sheets 15.

The invention claimed is:

1. A metal sheet ventilation/smoke exhaust duct section that is a part of a metal sheet ventilation/smoke exhaust duct, said duct section comprising metal sheets covered on an outside thereof by a heat insulating material having an outer surface, elongated stiffening bar members arranged against the outer surface of the heat insulating material, said elongated stiffening bar members extending substantially transversely to an axial direction of said duct section and being attached by separate connecting means extending through said insulating material to said metal sheets at discrete locations along a length of the bar members.

2. The metal sheet ventilation/smoke exhaust duct section according to claim 1, wherein said bar members are metal bar members.

3. The metal sheet ventilation/smoke exhaust duct section according to claim 1, wherein, said duct section includes at least two of said bar members spaced apart along the axial direction of said duct section.

4. The metal sheet ventilation/smoke exhaust duct section according to claim 1, wherein said bar members are rigidly connected at the ends thereof to form a frame extending peripherally around said duct section.

5. The metal sheet ventilation/smoke exhaust duct section according to claim 1, said bar members are received in an elongated groove formed in said insulating material.

6. The metal sheet ventilation/smoke exhaust duct section according to claim 3, wherein said bar members are supported by said insulating material.

7. The metal sheet ventilation/smoke exhaust duct section according to claim 1, wherein said insulating material has a thickness of 35 mm-200 mm.

8. The metal sheet ventilation/smoke exhaust duct section according to claim 1, wherein said insulating material is a mineral wool product having a density of 50 $kg/m^3$-350 $kg/m^3$.

9. The metal sheet ventilation/smoke exhaust duct section according to claim 1, wherein said connecting means comprises metal screws engaging said bar members at discrete locations along the length of said bar members.

10. The metal sheet ventilation/smoke exhaust duct section according to claim 1, wherein said discrete locations are spaced apart by 200 mm-700 mm.

11. The metal sheet ventilation/smoke exhaust duct section according to the claim 10, wherein said discrete locations are spaced apart by 250 mm-500 mm.

12. The metal sheet ventilation/smoke exhaust duct section according to claim 1, wherein said bar members have a U-shaped cross-section with a bottom of said U being located farthest from the duct section.

13. The metal sheet ventilation/smoke exhaust duct section according to claim 1, wherein said bar members having a T-shaped cross-section with the head of said T being located farthest from said duct section.

14. The metal sheet ventilation/smoke exhaust duct section according to claim 1, wherein said insulating material extends between said metal sheet and said stiffening bar members.

15. A method for making a metal sheet ventilation/smoke exhaust duct section that is a part of a metal sheet ventilation/smoke exhaust duct, said duct section having metal sheets covered on an outside thereof by a heat insulating material having an outer surface, elongated stiffening bar members arranged against the outer surface of the insulating material, said bar members extending essentially transversally to an axial extension of said duct section, said method comprising applying connecting means extending through said insulating material to attach said bar members to said metal sheets at discrete locations along a length of said bar members.

16. The method according to claim 15, including locating at least two of said bar members spaced apart along an axial direction of said duct section.

17. The method according to claim 15, wherein said bar members are rigidly connected at the ends thereof to form a frame extending peripherally around said metal sheets.

18. The method according to claim 15, comprising forming elongated grooves in said insulating material and locating one of said bar members within a corresponding one of said grooves.

19. The method according to claim 15, wherein said connecting means are metal screws engaging said bar members and said metal sheets.

20. The method according to, said metal screws are applied at a mutual spacing of 200 mm-700 mm.

21. The method according to claim 15, said bar members have a U-shaped cross-section with a bottom of said U being located farthest from said metal sheets.

22. The method according to claim 15, wherein said bar members have a T-shaped cross-section with the head of the T being located farthest from said metal sheets.

* * * * *